US008397353B2

(12) United States Patent
Chou

(10) Patent No.: US 8,397,353 B2
(45) Date of Patent: Mar. 19, 2013

(54) CONTINUOUS-COIL TYPE WATERPROOF SLIDE FASTENER AND THE STRUCTURE IMPERVIOUS TO FLUID THEREOF

(75) Inventor: Chao-Mu Chou, Taipei (TW)

(73) Assignees: Chao-Mu Chou, Taipei (TW); Shiu-Yin Cheng, Taipei (TW)

( * ) Notice: Subject to any disclaimer, the term of this patent is extended or adjusted under 35 U.S.C. 154(b) by 433 days.

(21) Appl. No.: 12/615,473

(22) Filed: Nov. 10, 2009

(65) Prior Publication Data

US 2010/0125982 A1 May 27, 2010

(30) Foreign Application Priority Data

Nov. 26, 2008 (TW) ..... 97145628 A
Jul. 23, 2009 (TW) ..... 98124838 A

(51) Int. Cl.
*A44B 19/32* (2006.01)

(52) U.S. Cl. ..... 24/391; 24/392

(58) Field of Classification Search ..... None
See application file for complete search history.

(56) References Cited

U.S. PATENT DOCUMENTS 4,058,145 A * 11/1977 Frohlich et al. ..... 139/384 B
5,129,127 A * 7/1992 Hamatani ..... 24/394
6,427,294 B1 * 8/2002 Shibaike et al. ..... 24/398
6,497,014 B2 * 12/2002 Neugebauer ..... 24/389
7,137,177 B2 * 11/2006 Fujii et al. ..... 24/433
2001/0013158 A1 * 8/2001 Yamaguchi et al. ..... 24/391
2002/0017010 A1 * 2/2002 Neugebauer ..... 24/391
2005/0235466 A1 * 10/2005 Segawa et al. ..... 24/396
2006/0101632 A1 * 5/2006 Yang ..... 29/408
2008/0248146 A1 * 10/2008 Yang ..... 425/95

* cited by examiner

*Primary Examiner* — Jack W. Lavinder

(74) *Attorney, Agent, or Firm* — Guice Patents PLLC

(57) ABSTRACT

A continuous-coil type waterproof slide fastener includes two support tapes each having opposing first face and second face, two rows of coupling elements respectively formed of a continuous length of monofilament and respectively secured to along the inner longitudinal edge of the second face of each of the two support tapes, a high polymer elastic member bonded to the vertical wall of the inner longitudinal edge of each support tape and transversely extending from the vertical wall of the inner longitudinal edge to a predetermined distance, each high polymer elastic member further having a covering portion on the inner longitudinal edge of the second face of the associating support tape and a filling portion penetrates into inner chinks in the associating row of coupling elements, and a fluid impervious film covered at least on the first face of each support tape and the associating high polymer elastic member.

14 Claims, 11 Drawing Sheets

CONTINUOUS-COIL TYPE WATERPROOF SLIDE FASTENER AND THE STRUCTURE IMPERVIOUS TO FLUID THEREOF

BACKGROUND OF THE INVENTION

1. Field of the Invention

The present invention relates to a waterproof slide fastener and more particularly, to a continuous-coil type waterproof slide fastener.

2. Description of Related Art

Slide fasteners are commonly seen in daily life and often deemed as necessary fastening devices; due to the property of easily being closed or open, a slide fastener is adopted in various applications, such as garments, bags, tents or skiwear involved.

Because slide fasteners are adopted in various objects, they can be seen on various occasions, but those slide fasteners adopted in garments of sports or devices of the outdoors, like skiwear, windbreaks, raincoats, tents, or those adopted in snow or travel equipments, even like a sleeping bag, are all subject to nature test, the weather for instance.

For achieving the function of wind breaking and waterproof, materials of nylon or cloth processed with a water-repellent finishing are used as fabrics for making skiwear of outdoors and a waterproof interlining is also provided, thus a waterproof function is obtained. There is a disadvantage on a slide fastener when applied as a fastening device on the skiwear in view of waterproof function, for the whole waterproof property may not be totally provided. Moreover, in operation, a chink defined the central slit between the support tapes and the coupling elements of a slide fastener would be enlarged by an transversal external force, which is the most difficult issue needed to be addressed to for a waterproof slide fastener, because such disadvantage would lower the whole waterproof property or even lose the whole waterproof function.

In view of the aforesaid drawbacks, improved slide fastener structures are created to provide a waterproof function. Regular nylon slide fasteners, i.e. continuous-coil type slide fasteners include three types: (1) capable of prohibiting water penetration under zero external pressure; (2) capable of prohibiting low pressure water penetration; and (3) capable of prohibiting high pressure water penetration. Regular waterproof slide fasteners commonly have a fluid impervious film (layer) covered on one side of each support tapes.

According to the aforesaid type (1), a fluid impervious film is bonded to each support tape to repel water. Exemplars of this design are seen in Taiwan Patent No. I220106; U.S. Pat. Nos. 3,764,437; 4,580,321; 4,596,065; 4,607,416; 4,724,586; 6,105,214 and 6,427,294. These disclosures show only the relative positioning difference between the fluid impervious film and the support tape. With respect to the central slit between the two support tapes, the aforesaid disclosures commonly teach the way to have the left and right sided fluid impervious film layer protrude over the inner longitudinal edge of the associating support tape so that the two fluid impervious films are squeezed against each to curve upwards for prohibiting penetration of water when the slide fastener is closed. However, when operating a slide fastener, a transverse tensile force will be produced and applied to each support tape to stretch open the central slit between the two support tapes and the two rows of coupling elements, causing an enclosure failure and permeation of water.

Further, if the fluid impervious film protrudes upwards, a special design of slider, for example, the slider of U.S. Pat. No. 6,622,351 shall be used, avoiding damage of the fluid impervious film caused by the slider. In this case, the range of application of the slide fastener is limited.

Further, Taiwan Patent No. I220106 discloses a waterproof slide fastener, which has the fluid impervious film bonded to the two support tapes subject to the curvature of the fabric surface. After installation, the fluid impervious film is high stretched. After the fluid impervious film is cut off along the central slit between the two support tapes, the inner longitudinal edge of each support tape is exposed to the outside of the fluid impervious film. Thus, water permeation due to a capillary effect may occur.

Exemplars of continuous coil type slide fasteners that are capable of prohibiting permeation of pressured fluid are seen in U.S. Pat. Nos. 3,389,441; 3,501,816; 4,112,150 and 5,437,888. These patents teach filling and wrapping of a fluid impervious material in and about each row coupling elements to prohibit permeation of water through the two rows of the coupling elements of the slide fasteners. The fluid impervious film is arranged on the support tape as the same side as the associating row of coupling elements as shown in FIG. 2 of the U.S. Pat. No. 3,501,816. Further, U.S. Pat. No. 3,668,745 discloses an invisible waterproof slide fastener using metal coupling elements for interlocking. These slide fasteners must use a specially designed slider to move the coupling elements into the locking condition. FIG. 3 of U.S. Pat. No. 3,668,745 and FIG. 5 of U.S. Pat. No. 6,622,351 disclose different sliders for this application. These waterproof slide fasteners and sliders do not fit the environmental protection and fashion requirements for a product having light, thin, short and small characteristics.

SUMMARY OF THE INVENTION

The present invention has been accomplished under the circumstances in view. It is one object of the present invention providing a continuous-coil type waterproof slide fastener, which eliminates water permeation due to a capillary effect and prohibits transferring an external force to the inside of the slider to interfere with the ordering of the coupling elements.

It is another object of the present invention providing a continuous-coil type waterproof slide fastener, which can be made in any of the various forms by means of a special manufacturing process for different applications, providing an excellent waterproof function during the use, avoiding damage of the fluid impervious film.

To achieve these and other objects of the present invention, a continuous-coil type waterproof slide fastener comprises a pair of symmetrical support tapes each having a first face, and a second face opposites to the first face and; the vertical wall of an inner longitudinal edge joins the first face and the second face; two rows of coupling elements respectively formed of a continuous length of monofilament and respectively secured to the support tapes along the inner longitudinal edge of the second face of each of the two support tapes; wherein a high polymer elastic member is bonded to the vertical wall of the inner longitudinal edge of each of the two support tapes and transversely extends from the vertical wall of the inner longitudinal edge of each of the two support tapes to a predetermined distance, the high polymer elastic member further comprising a covering portion on the inner longitudinal edge of the second face of each of the two support tapes, and a filling portion penetrates into inner chinks in each of the two rows of coupling elements bonded to each of the two rows of coupling elements; a fluid impervious film is covered on the first face of each of the two support tapes and the high polymer elastic member. Further, the high polymer elastic member and the fluid impervious film are cut off along the central slit between the two support tapes.

It is still another object of the present invention providing a fluid impervious structure for continuous-coil type waterproof slide fastener, which eliminates water permeation due to a capillary effect between the two support tapes and enables a high polymer elastic member to be filled in spaces and inner chinks in between each support tape and the associating row of coupling elements, enhancing smoothness and stability during interlocking between the two rows of coupling elements.

It is still another object of the present invention providing a fluid impervious structure for continuous-coil type waterproof slide fastener, which has the high polymer elastic members and the support tapes designed in contrast colors or added with a light reflective material, enhancing the level of safety and the sense of fashion while maintaining the waterproof function.

To achieve these and other objects of the present invention, a continuous-coil type waterproof slide fastener comprises a pair of symmetrical support tapes each having a first face, and a second face opposites to the first face; the vertical wall of an inner longitudinal edge joins the first face and the second face; two rows of coupling elements respectively formed of a continuous length of monofilament and respectively secured to the support tapes along the inner longitudinal edge of the second face of each of the two support tapes; wherein a high polymer elastic member is bonded to the vertical wall of the inner longitudinal edge of each of the two support tapes and transversely extends from the vertical wall of the inner longitudinal edge of each of the two support tapes to a predetermined distance, the high polymer elastic member further comprising a covering portion on the inner longitudinal edge of the second face of each of the two support tapes and a filling portion penetrates into inner chinks in each of the two rows of coupling elements. Further, the fluid impervious film is cut off along the central slit between the two support tapes.

DETAILED DESCRIPTION OF THE PREFERRED EMBODIMENT

Figure 1:
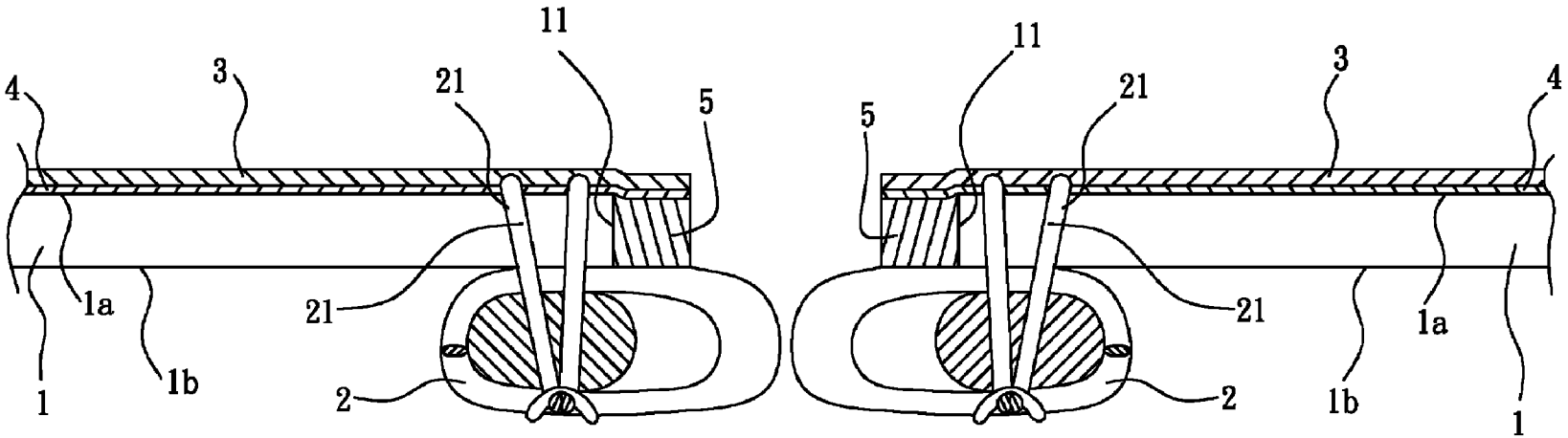
FIG. 1 is a sectional view of a continuous coil type waterproof slide fastener in accordance with a first embodiment of the present invention.

Referring to FIG. 1, a continuous-coil type waterproof slide fastener in accordance with a first embodiment of the present invention is shown comprising a pair of oppositely disposed support tapes 1. The support tapes 1 may be prepared from a knitted or woven fabric. When necessary, the support tapes 1 can be made elastically stretchable in weft or warp direction. Each support tape 1 has a first face 1*a* and a second face 1*b* opposite to the first face 1*a*. Each support tape 1 has a row of coupling elements 2 secured along the inner longitudinal edge of the inner surface, namely, the second face 1*b* thereof with sewing stitches 21.

The row of coupling elements 2 is formed from a continuous length of nylon or polyester monofilament through a heating and spirally rotating procedure into a continuous helical coil structure, and secured along the inner longitudinal edge of the second face 1*b* of each support tape 1 with sewing stitches 21. When viewing from the top side, the two rows of coupling elements 2 are concealed beneath the two support tapes 1 and kept from sight.

As shown in FIG. 1, each support tape 1 has at least one face thereof, for embodiment, the first face 1*a* covered with a fluid impervious film 3. The fluid impervious film 3 may be a high polymer elastic film prepared from, but not limited to, polyurethane (PU). The fluid impervious film 3 is bonded to the first face 1*a* of each support tape 1 with an adhesive 4. The other face, namely, the second face 1*b* of each support tape 1 is treated with a water repellent agent, enhancing the waterproof effect.

The main features of the present invention are outlined hereinafter. Each support tape 1 has a high polymer elastic member 5 bonded to the vertical wall of the inner longitudinal edge 11 thereof. The high polymer elastic member 5 is prepared from thermoplastic urethane (TPU) or silicon rubber. The high polymer elastic member 5 extends transversely from the vertical wall of the inner longitudinal edge 11 of each support tape 1 to a predetermined distance when bonded thereto. The high polymer elastic member 5 is adapted to fill up the central slit of the slide fastener and to shield the fibers of the first face 1*a* of the inner longitudinal edge 11 of each support tape 1. After bonding of the high polymer elastic member 5 to each support tape 1, a fluid impervious film 3 is adhered to the first face 1*a* of each support tape 1 and the associating high polymer elastic member 5. Thus, the fluid impervious film 3 and the high polymer elastic member 5 are joined together. This arrangement prevents permeation of a fluid through exposed fiber capillaries of the vertical wall of the inner longitudinal edge 11 of each support tape 1 or the central slit between the two support tapes 1 into the second surface 1*b* of each support tape 1.

Figure 2:
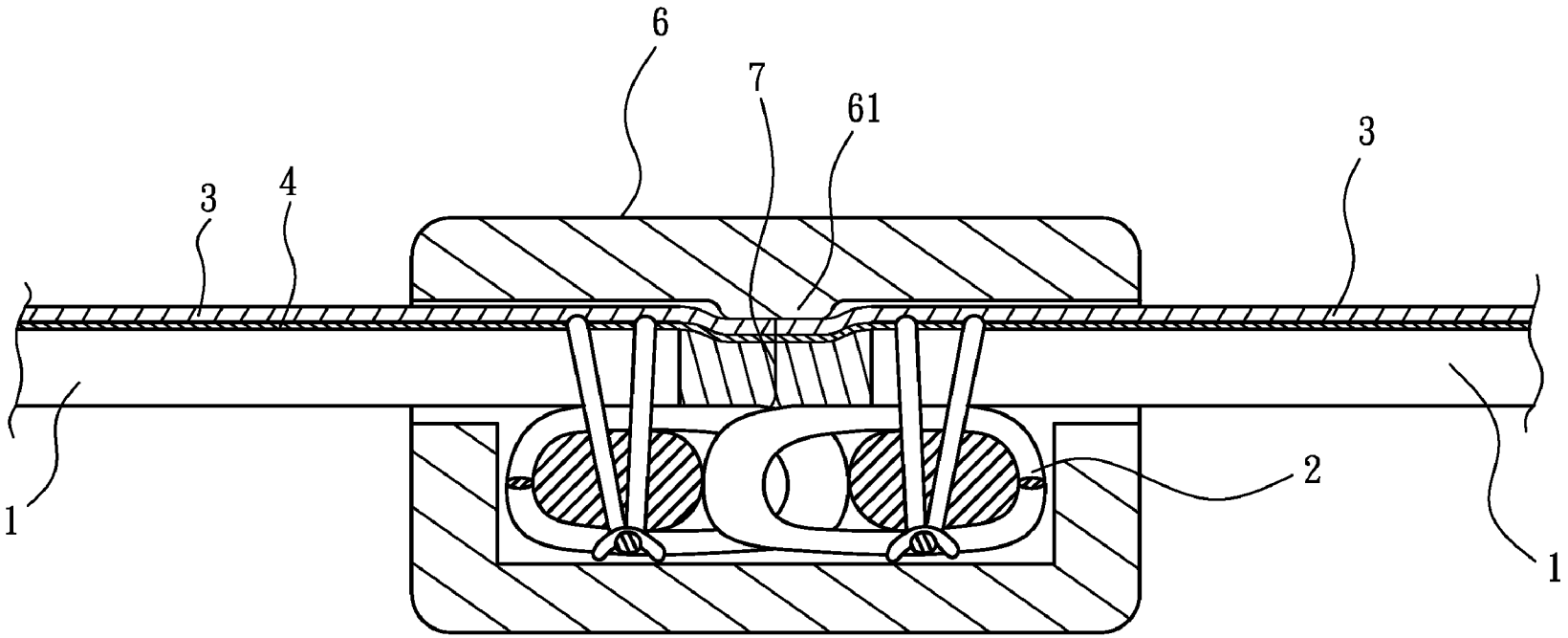
FIG. 2 is a sectional view of the present invention, showing the position of the two support tapes and the two rows of coupling elements in the slider.

As shown in FIG. 2, the two rows of coupling elements 2 of the two support tapes 1 are interlocked by means of a slider 6. The high polymer elastic member 5 is bonded to the vertical wall of the inner longitudinal edge 11 of each support tape 1 by means of a hot-press forming technique. After formation, the height of the high polymer elastic member 5 at each support tape 1 is slightly lower than the first face 1*a* of each support tape 1. After adhered the fluid impervious film 3 to the first face 1*a* of each support tape 1 and the associating high polymer elastic member 5, a recessed area exists corresponding to the high polymer elastic member 5 at each support tape 1, facilitating passing of the internal ribs 61 of the slider 6. Thus, the continuous-coil type waterproof slide fastener is compatible to different commercial sliders for slide fastener. When the continuous-coil type waterproof slide fastener is closed, the high polymer elastic members 5 of the support tapes 1 are abutted against each other to block the central slit 7 in between the two support tapes 1. At the same time, the fluid impervious films 3 of the support tapes 1 are also abutted against each other, enhancing the waterproof effect.

Figure 3:
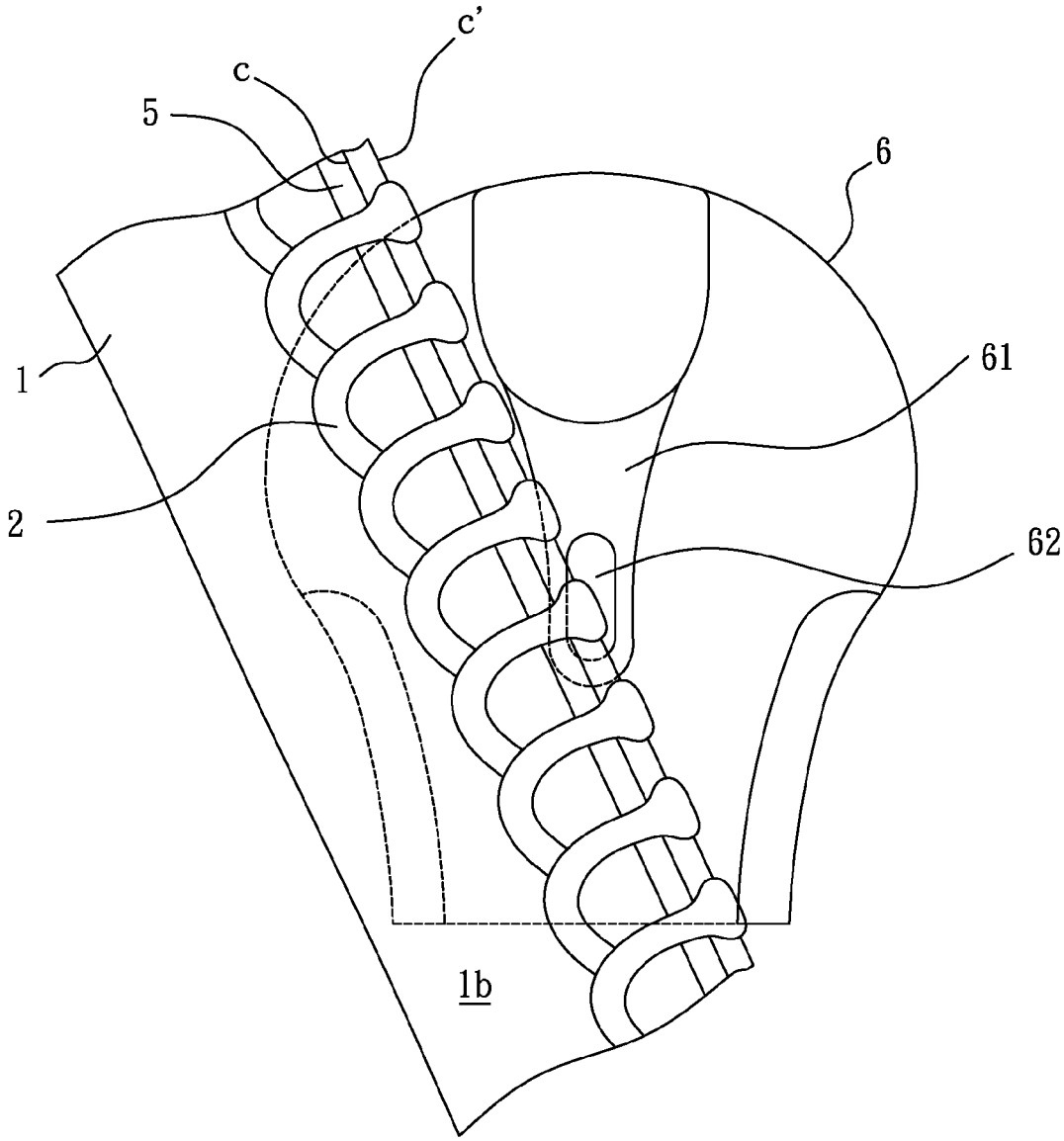
FIG. 3 is a schematic drawing showing relative position of one support tape in the slider between the present invention and the prior art design.

FIG. 3 is a schematic drawing showing comparison between the present invention and the prior art waterproof slide fastener. In FIG. 3, line c indicates the position of the edge of the high polymer elastic member 5 at the vertical wall of the inner longitudinal edge 11 of one support tape 1 of the continuous-coil type waterproof slide fastener in accordance with the present invention and the edge of the high polymer elastic member 5 kept in contact with the internal needle lock 62 and rib 61 of the slider 6; line c' indicates the position of the edges of one support tape and the associating fluid impervious film of the prior art waterproof slide fastener. As shown in FIG. 3, the contact area between line c' and the internal needle lock 62 and rib 61 of the slider 6 is much greater than the contact area between line c and the internal needle lock 62 and rib 61 of the slider 6. The invention uses the soft, durable and tough high polymer elastic member 5 to substitute for the coarse and hard support tape and fluid impervious film of the prior art design, thereby overcoming the drawbacks of poor waterproof effect and low durability of the prior art design.

Figure 4:
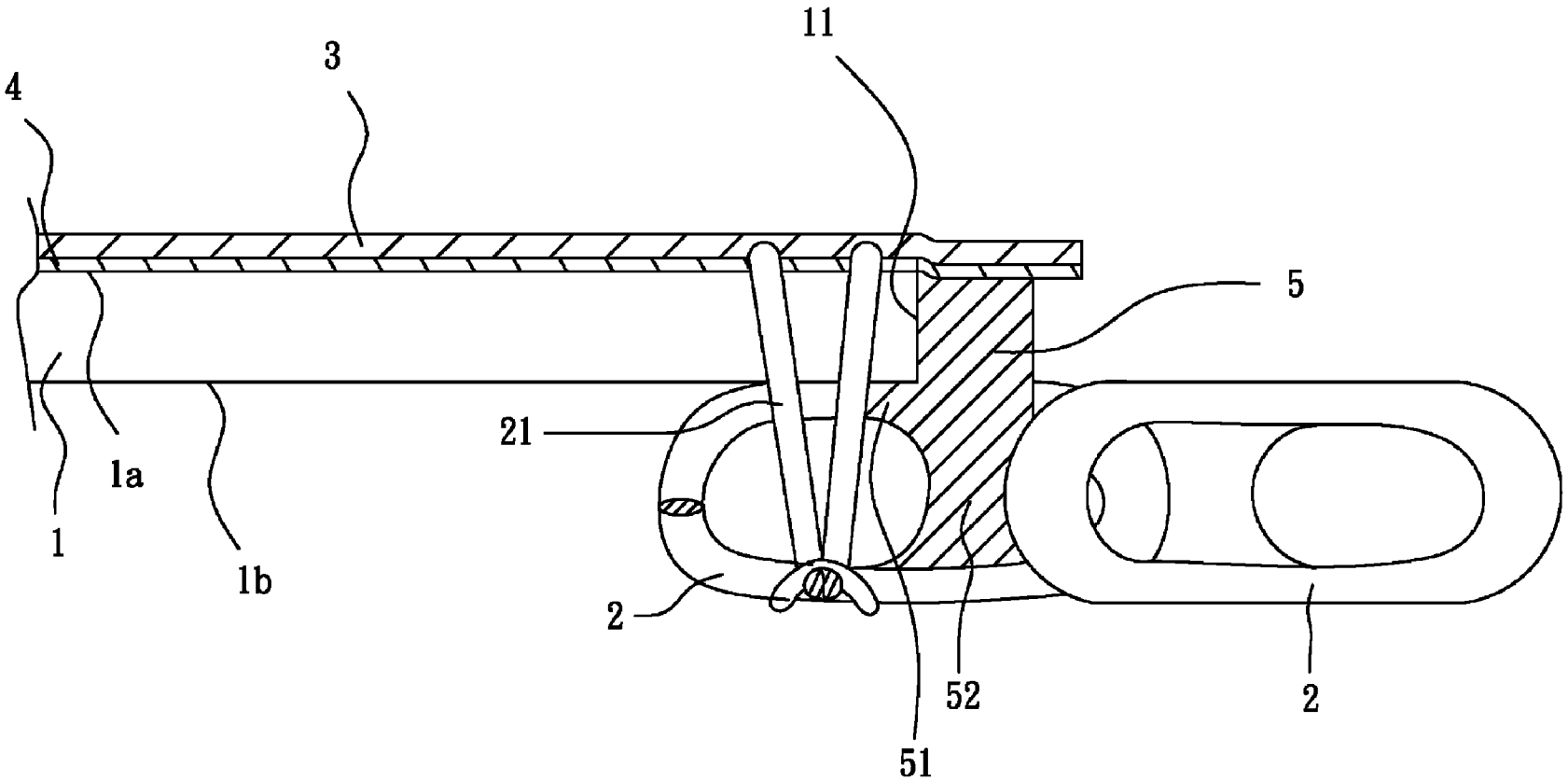
FIG. 4 is a schematic sectional view of a continuous-coil type waterproof slide fastener in accordance with a second embodiment of the present invention.

FIG. 4 illustrates a continuous-coil type waterproof slide fastener in accordance with a second embodiment of the present invention. When the high polymer elastic member 5 is bonded to the vertical wall of the inner longitudinal edge 11 of the support tape 1, it forms a covering portion 51 that wraps about the inner edge of the second face 1*b*. Thereafter, the fluid impervious film 3 is adhered to the first face 1*a* of each support tape 1 and the associating high polymer elastic member 5. After bonding, the fluid impervious film 3 protrudes over the inner edge of the associating high polymer elastic member 5. Further, the high polymer elastic member 5 penetrates into inner chinks in the associating row of coupling elements 2, forming a filling portion 52 to enhance the waterproof effect and durability of the continuous-coil type waterproof slide fastener.

Figure 5:
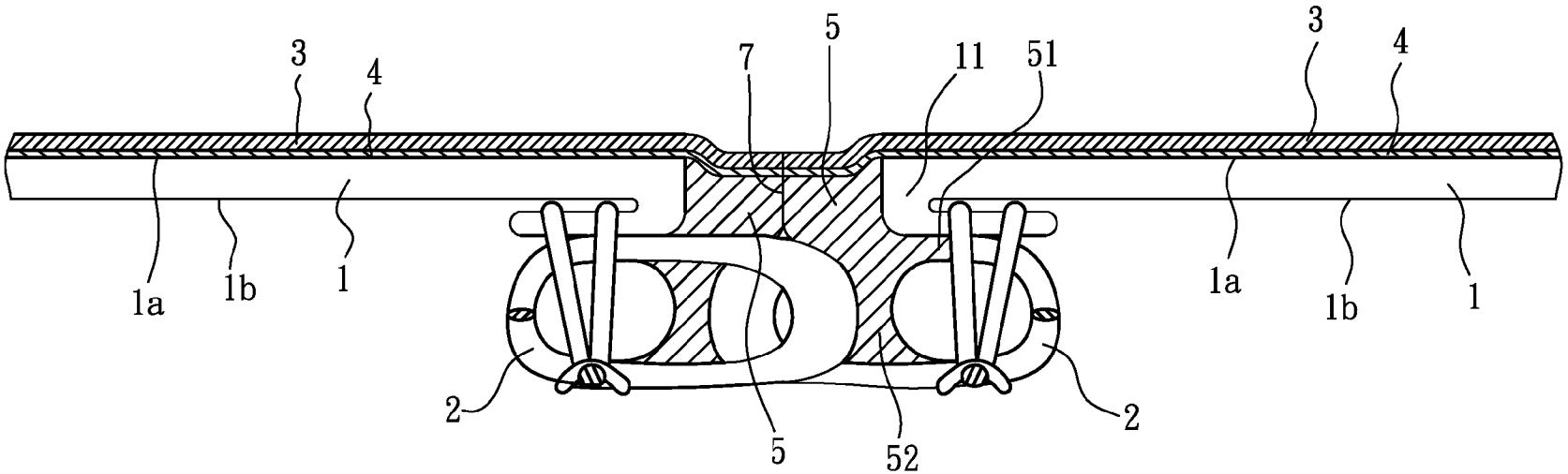
FIG. 5 is a schematic sectional view of a continuous-coil type waterproof slide fastener in accordance with a third embodiment of the present invention.

As stated above, the high polymer elastic member 5 penetrates into inner chinks in the associating row of coupling elements 2, forming a filling portion 52 that resists against a transverse tensile force to open the central slit between the two support tapes 1. Further, the high polymer elastic member 5 does not protrude over the associating row of coupling elements 2. Because the row of coupling elements 2 and the fluid impervious film 3 are not curved outwards relative to the respective support tape 1, the invention does not require a specially designed slider. Therefore, the invention enhances the durability of the slide fastener and prevents permeation of a forced fluid. FIG. 5 illustrates the use of the covering portion 51 and filling portion 52 of the high polymer elastic member 5 in an invisible slide fastener, i.e., the row of coupling elements 2 is secured to the folded edge of the second face 1*b* of each support tape 1 and kept from sight. Thus, a conventional invisible slide fastener can be modified into a waterproof slide fastener, forming a third embodiment of the present invention.

Figure 6:
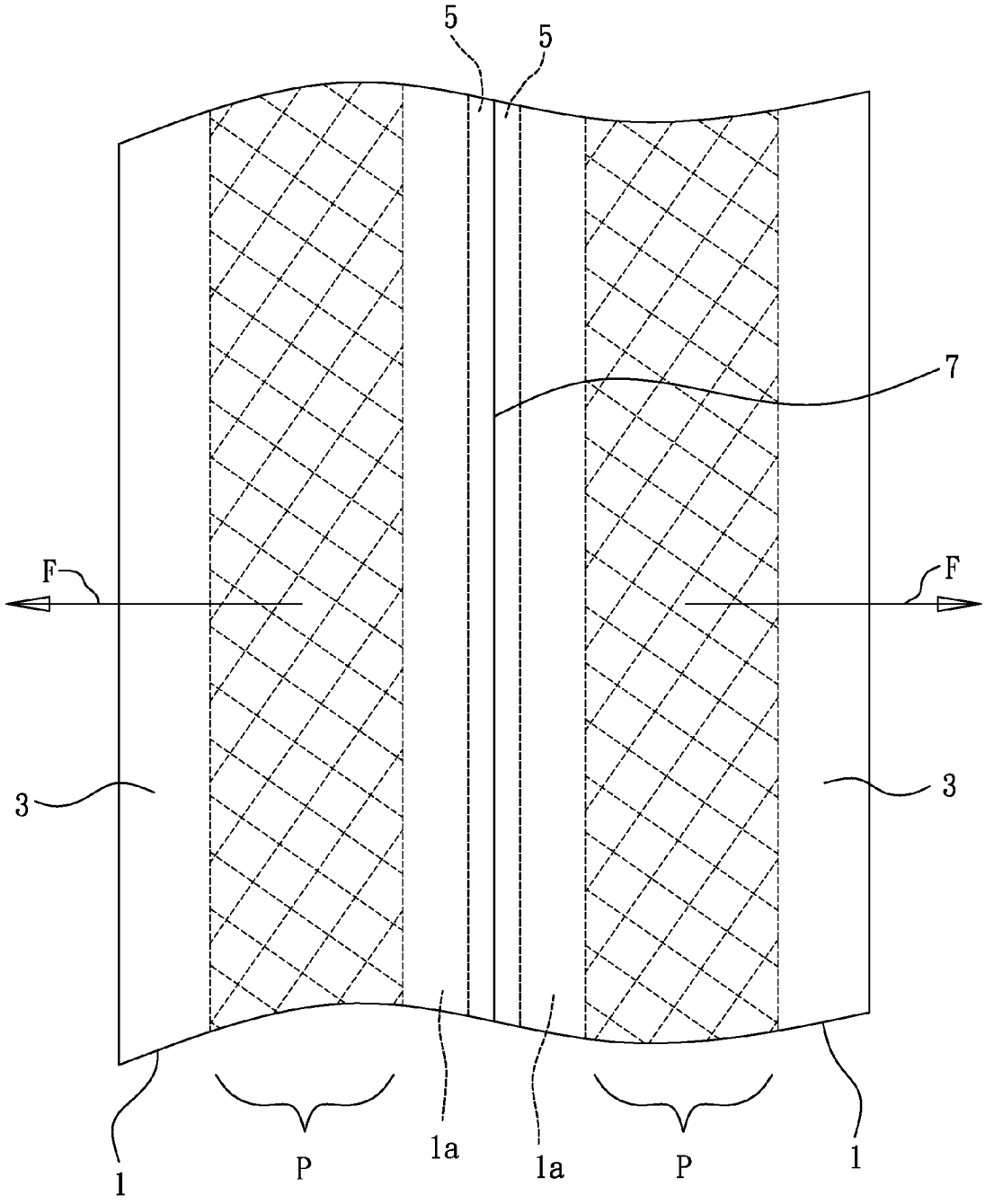
FIG. 6 is a schematic sectional view of a continuous-coil type waterproof slide fastener in accordance with a fourth embodiment of the present invention.

In conclusion, if the support tape 1 has the characteristic of transverse elasticity, as shown in FIG. 6, the transverse tensile force F produced during the use of the slide fastener will be absorbed or lessened by the elastic structure P of each support tape 1 and will not be transferred to the interlocked points between the two rows of coupling elements 2 to open the central slit 7 in between the two support tapes 1, enhancing the waterproof effect.

Figure 7:
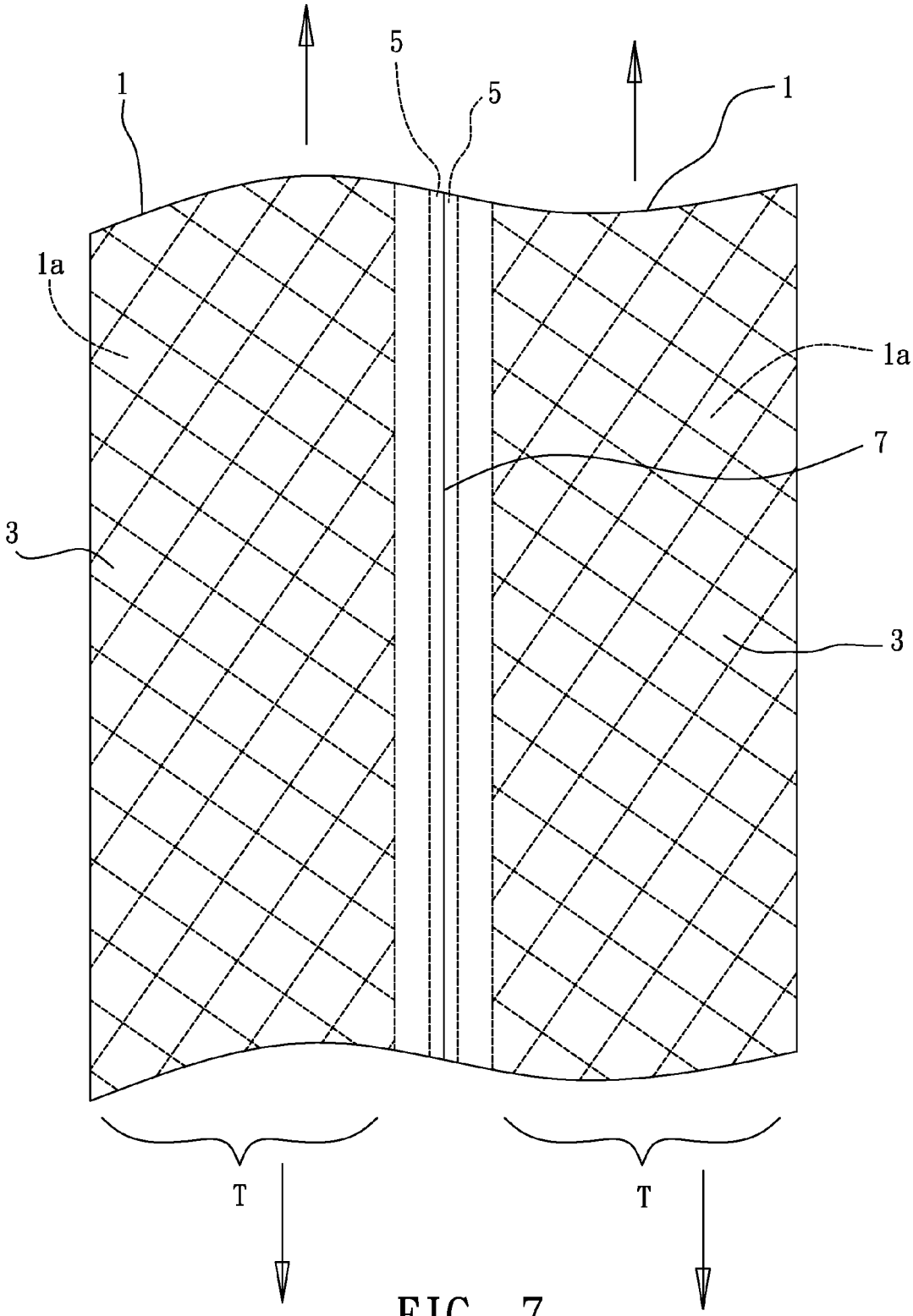
FIG. 7 is a schematic sectional view of a continuous-coil type waterproof slide fastener in accordance with a fifth embodiment of the present invention.

As shown in FIG. 7, if part T of the support tape 1 is elastically stretchable in longitudinal direction, as the disclosure of U.S. Pat. No. 6,494,236 of the present inventor, a slide fastener made of this specially designed support tape 1 provides a side-curving function, widening the application range of the waterproof slide fastener.

Actually, in order to improve waterproof function, the invention utilizes the high polymer elastic member 5 to fill the central slit in between the two support tapes 1 of the slide fastener and to shield the exposed fibers of the vertical wall of the inner longitudinal edge 11 of each support tape 1. The fabrication of the waterproof slide fastener includes the step of:

(1) filling a proper amount of thermoplastic urethane (TPU) into the central slit in between the two support tapes 1 with a pressure as the slide fastener is closed, thereby forming a high polymer elastic member 5 on the vertical wall of the inner longitudinal edges 11 of the two support tapes 1; or (2) filling a proper amount of thermoplastic urethane (TPU) onto the vertical wall of the inner longitudinal edge 11 of each of the two support tapes 1 with a pressure, thereby forming a respective high polymer elastic member 5 on the vertical wall of the inner longitudinal edge 11 of each of the two support tapes 1.

After formation of the high polymer elastic member 5 on the vertical wall of inner longitudinal edge 11 of each of the two support tapes 1, a fluid impervious film 3 is formed on each of the two support tapes 1 by:

(1) directly or indirectly laminating a thermoplastic high polymer elastic material, for embodiment, but not limited to, thermoplastic polyurethane (TPU) on the first face 1*a* of each of the support tapes 1 by extrusion lamination technique, thereby forming a fluid impervious film 3; or (2) coating an adhesive 4 evenly on the back side of a fluid impervious film 3 prepared from, for embodiment, but not limited to, thermoplastic polyurethane (TPU), and then adhering the fluid impervious film 3 to the first face 1*a* of each of the support tapes 1 directly by a hot-press; or (3) coating an adhesive 4 on the first face 1*a* of each of the support tapes 1 evenly, and then adhering a fluid impervious film 3 prepared from, for embodiment, but not limited to, thermoplastic polyurethane (TPU) to the adhesive 4 on the first face 1*a* of each of the support tapes 1 by a hot-press process; or (4) directly adhering a fluid impervious film 3 of thermoplastic high polymer elastic material, for embodiment, but not limited to, thermoplastic polyurethane that has a thermoplastic adhesive 4 provided at the back side thereof to the first face 1*a* of each of the support tapes 1.

The fluid impervious film 3 and high polymer elastic member 5 of the waterproof slide fastener are cut off subject to the step of:

(1) cutting off the fluid impervious film 3 and the high polymer elastic member 5 with a cutting tool at one same time after bonding of the fluid impervious film 3 in case the high polymer elastic member 5 is formed by means of filling a proper amount of thermoplastic urethane (TPU) into the central slit in between the two support tapes 1 with a pressure; or (2) cutting off the fluid impervious film 3 with a cutting tool in case one respective high polymer elastic member 5 is formed on the vertical wall of the inner longitudinal edge 11 of each of the two support tapes 1 by respectively filling a proper amount of thermoplastic urethane (TPU) onto the vertical wall of the inner longitudinal edge 11 of each of the two support tapes 1 with a pressure.

Figure 8:
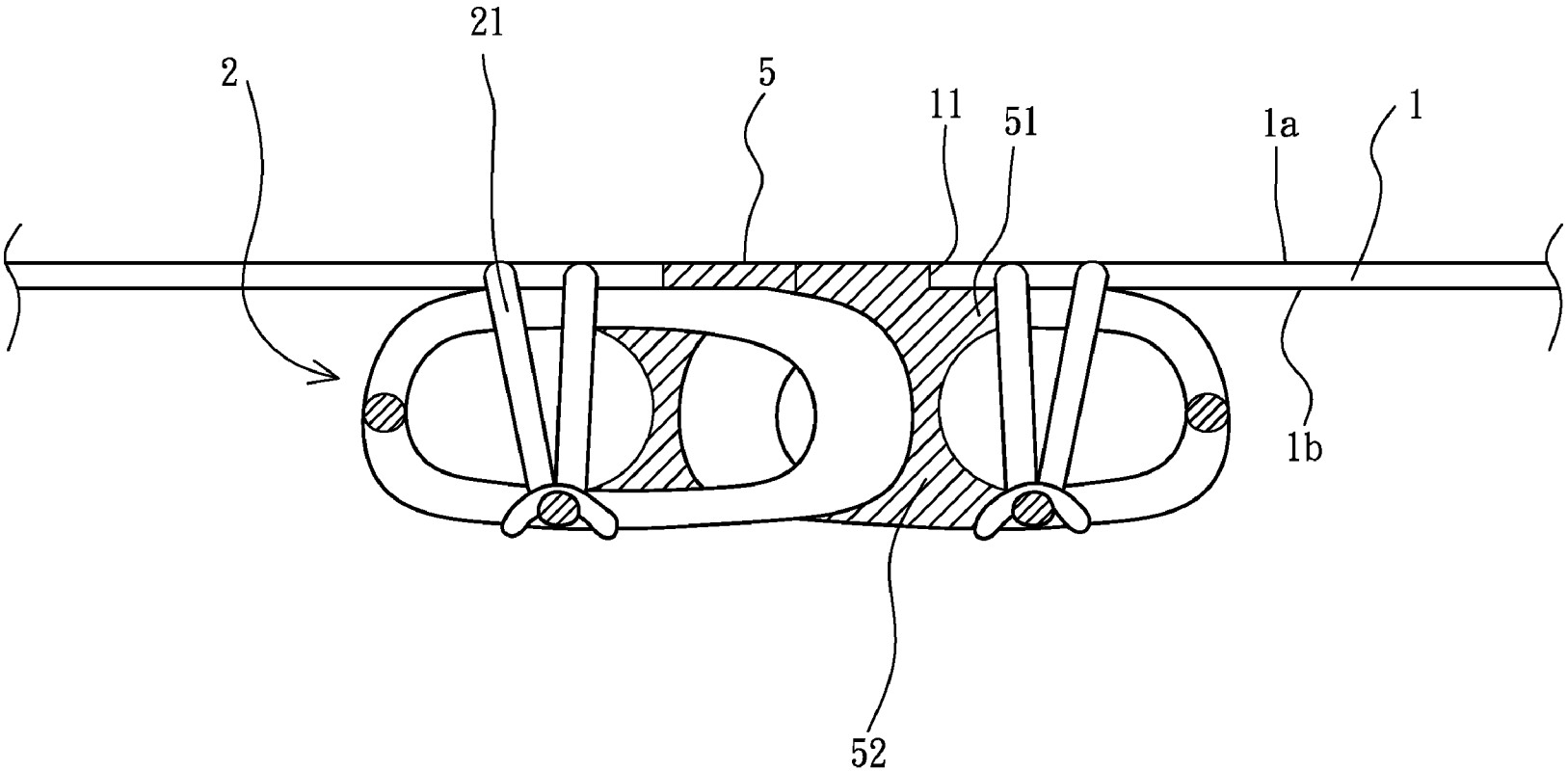
FIG. 8 is a sectional view of a first embodiment of the fluid impervious structure of the continuous-coil type waterproof slide fastener in accordance with the present invention.

FIGS. 8~11 illustrate various different embodiments of the fluid impervious structure of the continuous-coil type waterproof slide fastener in accordance with the present invention. FIG. 8 illustrates a first embodiment of the impervious structure of the continuous-coil type waterproof slide fastener in accordance with the present invention. This embodiment eliminates the arrangement of the aforesaid fluid impervious film on the first face 1*a* of each support tape 1 but has the first face 1*a* of each support tape 1 be treated with a water repellent agent, enhancing the waterproof effect. If the support tape 1 is woven from micro-fiber yarn, it can be treated with a water repellent agent to provide an excellent waterproof effect, preventing permeation of a non-pressure fluid that is not forced by an external force.

As shown in FIG. 8, the waterproof slide fastener comprises two oppositely disposed support tapes 1. The support tapes 1 may be prepared from a knitted or woven fabric. When necessary, the support tapes 1 can be made elastically stretchable in weft or warp direction. Each support tape 1 has a first face 1*a* and a second face 1*b* opposite to the first face 1*a*. Each support tape 1 has a row of coupling elements 2 secured along the inner longitudinal edge of the inner face, namely, the second face 1*b* thereof with sewing stitches 21. When the high polymer elastic member 5 is bonded to the vertical wall of the inner longitudinal edge 11 of the support tape 1, it forms a covering portion 51 that wraps about the inner edge of the second face 1*b*. Further, the high polymer elastic member 5 penetrates into inner chinks in the associating row of coupling elements 2, forming a filling portion 52 to enhance the waterproof effect and durability of the continuous-coil type waterproof slide fastener.

The row of coupling elements 2 is formed from a continuous length of nylon or polyester monofilament through a heating and spirally rotating procedure into a continuous helical coil structure, and secured along the inner longitudinal edge of the second face 1*b* of each support tape 1 with sewing stitches 21. When viewing from the top side, the two rows of coupling elements 2 are concealed beneath the two support tapes 1 and kept from sight.

Figure 9:
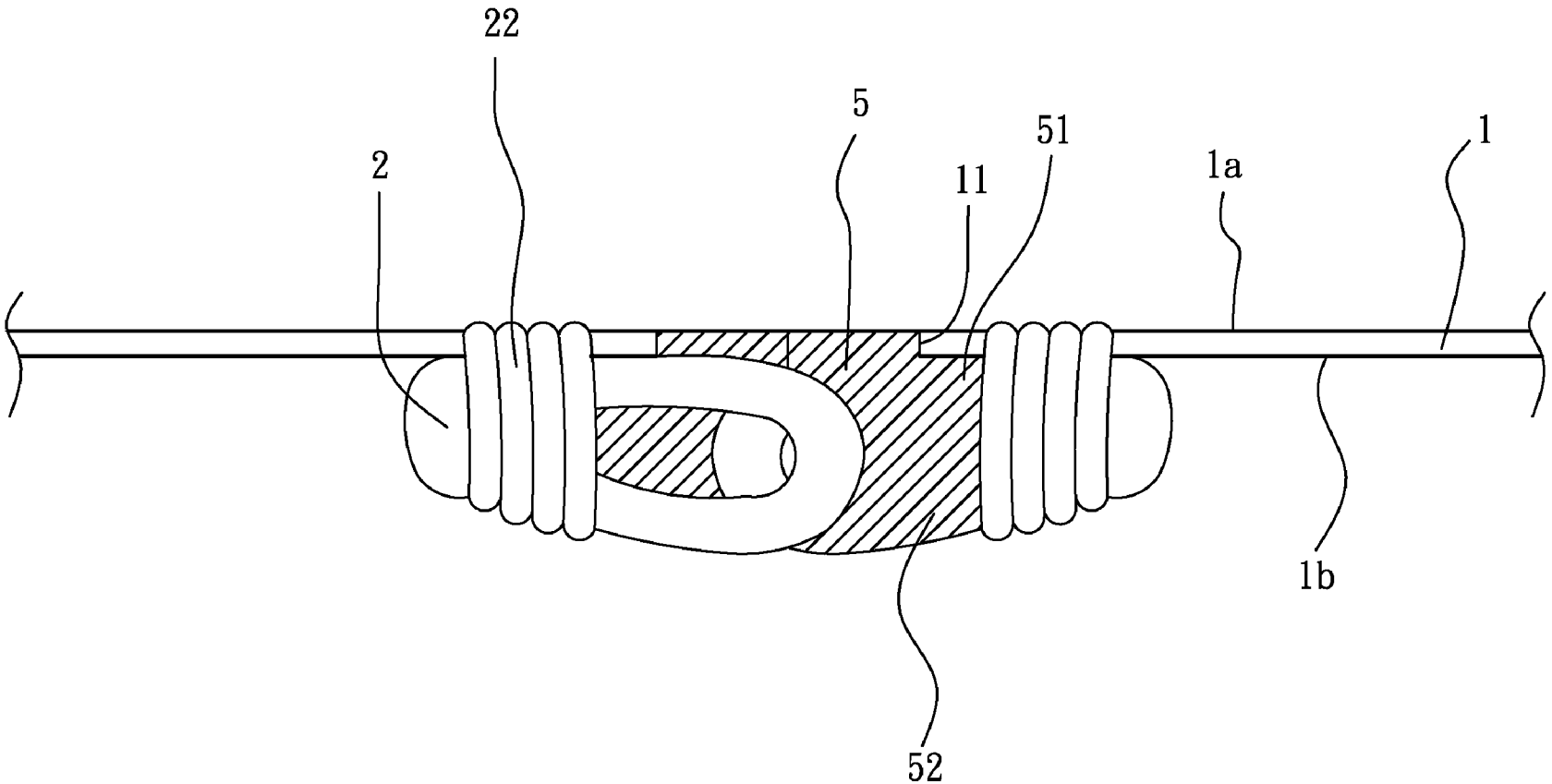
FIG. 9 is a sectional view of a second embodiment of the fluid impervious structure of the continuous-coil type waterproof slide fastener in accordance with the present invention.

In actual practice, the two rows of coupling elements 2 can be respectively secured to the two support tapes 1 with sewing stitches 21, thereby forming a C-type slide fastener, as shown in FIG. 8. Alternatively, the two rows of coupling elements 2 can be respectively directly secured to the two support tapes 1 by warp and weft yarns 22 during weaving the support tapes 1, thereby forming an S-type slide fastener as shown in FIG. 9. Alternatively, the two rows of coupling elements 2 can be respectively directly secured to the folded second face 1*b* of each of the two support tapes 1, thereby forming an invisible slide fastener as shown in FIG. 10.

Figure 10:
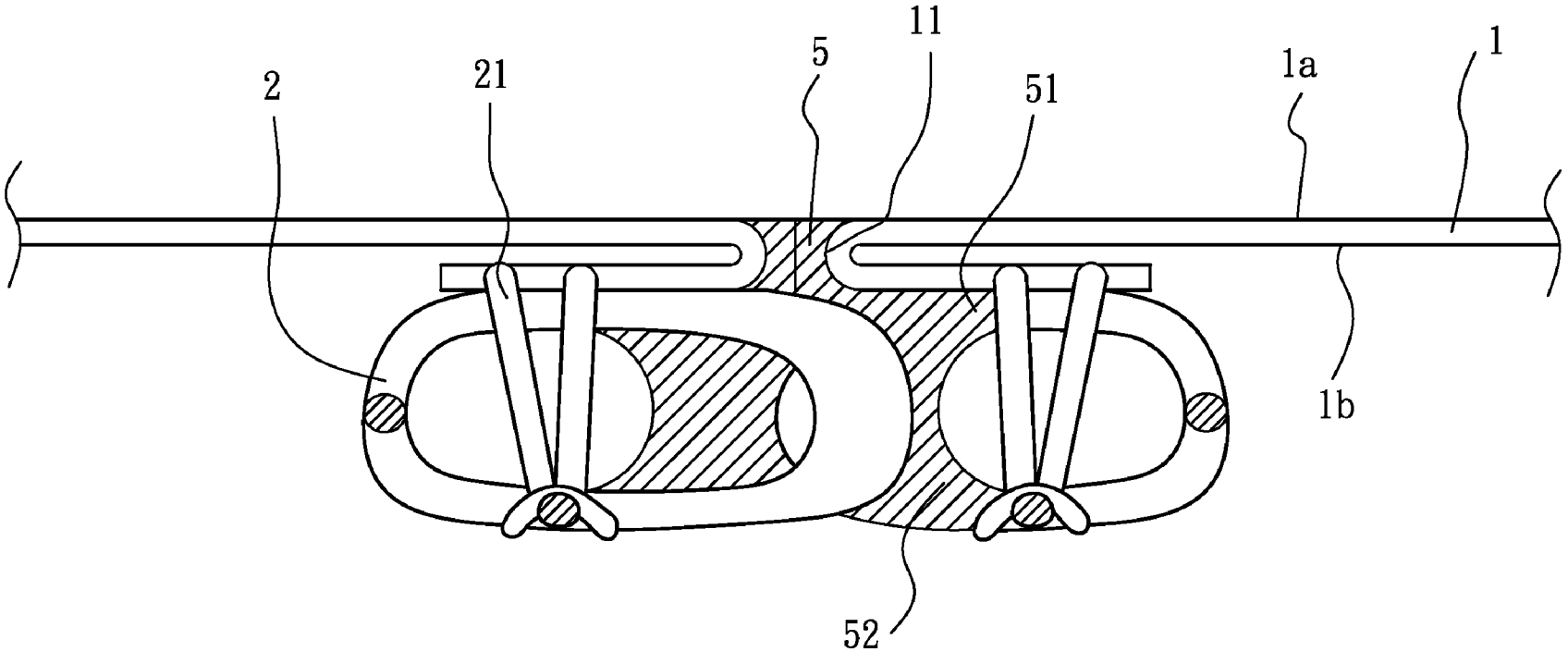
FIG. 10 is a sectional view of a third embodiment of the fluid impervious structure of the continuous-coil type waterproof slide fastener in accordance with the present invention.

According to the embodiments shown in FIGS. 8~10, the fluid impervious structure is to bond a high polymer elastic member 5 to the vertical wall of the inner longitudinal edge 11 of each support tape 1. The high polymer elastic member 5 can be prepared from thermoplastic urethane (TPU) or silicon rubber. Further, the high polymer elastic member 5 extends transversely from the vertical wall of the inner longitudinal edge 11 of the associating support tape 1 to a predetermined distance and filled in spaces and gaps in between the respective support tape 1 and the respective row of coupling elements 2.

The high polymer elastic member 5 is adapted to fill up the spaces and inner chinks in between the respective support tape 1 and the respective row of coupling elements 2 and to shield the fibers of the vertical wall of the inner longitudinal edge 11 of respective support tape 1. This arrangement prevents permeation of a fluid through exposed fiber capillaries of the vertical wall of the inner longitudinal edge 11 of the support tape 1 or the central slit between the two support tapes 1 into the second surface 1*b* of each support tape 1.

As stated above, the high polymer elastic member 5 penetrates into inner chinks in the associating row of coupling elements 2, forming a filling portion 52 to resist against a transverse tensile force in opening the central slit between the two support tapes 1. The high polymer elastic member 5 penetrates into the inner side of the associating support tape 1, thereby forming a covering portion 51 that enhances the waterproof effect. Because the high polymer elastic member 5 is not curved outwards relative to the associating support tape 1, the invention does not require a specially designed slider. Therefore, the invention enhances the durability of the slide fastener and prevents permeation of a fluid.

FIG. 10 illustrates an example of the application of the filling portion 52 of the high polymer elastic member 5 in an invisible slide fastener, i.e., the two rows of coupling elements 2 are respectively secured to the second face 1*b* of each of the two support tapes 1 and kept from sight. By means of the application of the technical features of the present invention, a conventional invisible slide fastener is formed into an invisible waterproof slide fastener.

Figure 11:
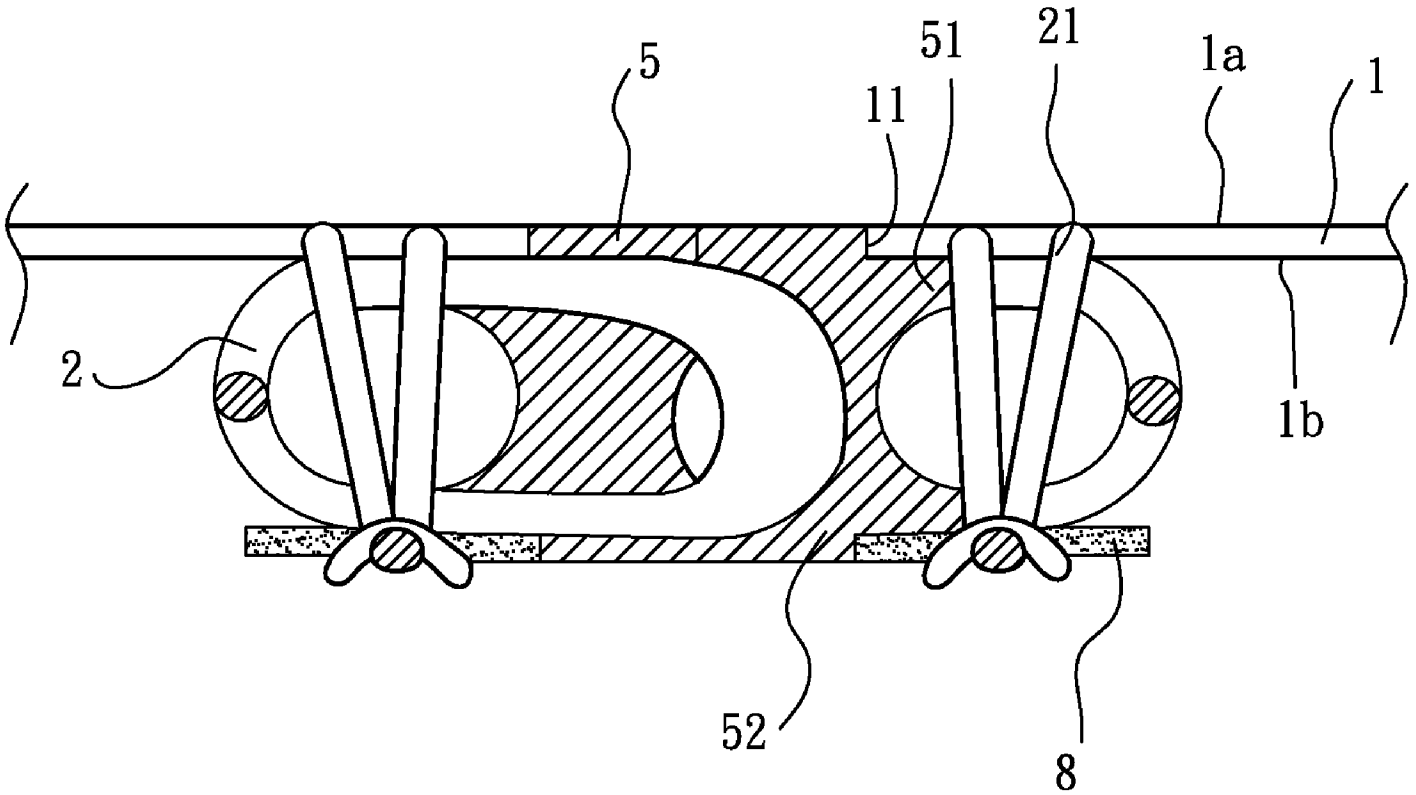
FIG. 11 is a sectional view of a fourth embodiment of the fluid impervious structure of the continuous-coil type waterproof slide fastener in accordance with the present invention.

FIG. 11 is a sectional view of a fourth embodiment of the fluid impervious structure of the continuous-coil type waterproof slide fastener in accordance with the present invention. According to this embodiment, the two positioning tapes 8 are respectively provided at the outer side of each of the two rows of coupling elements 2 so that the height of each high polymer elastic member 5 is maximized without protruding over the positioning tapes 8. This arrangement does not require a specially designed slider while enhancing the durability and fluid impervious functions.

In order to improve the fluid impervious function, the invention utilizes high polymer elastic members 5 to fill up spaces and chinks in between the respective support tapes and the respective rows of coupling elements 2 and to shield the exposed fibers of the vertical wall of the inner longitudinal edge 11 of each support tape 1. Thus, the preparation of the waterproof slide fastener is as follows:

Fill a proper amount of a polymeric material, for example, thermoplastic urethane (TPU) in any desired color into the central slit in between the two support tapes 1 with a pressure as the slide fastener is closed for enabling applied thermoplastic urethane (TPU) to penetrate into chinks in the two rows of coupling elements 2, thereby forming a high polymer elastic member 5 on the vertical wall of the inner longitudinal edges 11 of the two support tapes 1. The finished high polymer elastic member 5 does not protrude over the sewing stitches 21 of each positioning tape 8.

After the applied thermoplastic urethane (TPU) for high polymer elastic member 5 covered the vertical wall of the inner longitudinal edges 11 of the two support tapes 1 during the high polymer elastic member 5 formation process, keep applying the applied thermoplastic urethane (TPU) to have it penetrate into chinks in the two rows of coupling elements 2, and apply a water repellent agent to the first face 1*a* of each of the two support tapes 1 at the same time. The support tapes 1 are not limited to ultra-high density fabric.

After formation of the high polymer elastic member 5 on the vertical wall of the inner longitudinal edges 11 and chinks in the two rows of coupling elements 2 of the two support tapes 1, it is directly cut off into two separated high polymer elastic members 5 with a cutting tool, and a finished product of fluid impervious slide fastener is thus obtained.

In conclusion, the invention has numerous advantages and features as follow:

(1) When the slide fastener is closed, the high polymer elastic members and/or the fluid impervious films shield the central slit of the slide fastener and the vertical wall of the inner longitudinal edge of each of the two support tapes, eliminating water permeation due to a capillary effect.

(2) Connection between each row of coupling elements and the associating support tape does not require an enhanced fastening arrangement, facilitating the fabrication of the slide fastener and maintain high flexibility of the slide fastener; the invention prohibits transfer of an external force to the inside of the slider to interfere with the ordering of the coupling elements, thereby reducing the risk of damage and improving the yield rate.

(3) When the high polymer elastic members and the fluid impervious films touch each other at the central slit, they are squeezed against each other, thereby shielding the gap in between the two support tapes as the two support tapes are transversely outwardly stretched during the use of the slide fastener, and therefore the slide fastener effectively maintains the waterproof function.

(4) The invention utilizes flexible, durable and tough high polymer elastic members to substitute for conventional rough support tapes and the fluid impervious films, avoiding the fluid impervious film damage by the internal needle lock and rib of the slider upon friction.

(5) The design of the present invention to use the contact surfaces between the two high polymer elastic members for constituting the central slit between the two support tapes eliminates overlap of support tapes due to excessive contracting of the support tapes after dying.

(6) The design of the present invention to use the contact surfaces between the two high polymer elastic members for constituting the central slit between the two support tapes prevents a support tape cutting damage when cutting off the fluid impervious film.

(7) The formation of the high polymer elastic member on the vertical wall of the inner longitudinal edge of each support tape extends the contact area in the central slit between the two support tapes from a line contact status to a surface contact status, improving the fluid impervious function.

(8) The support tapes can be made having a transversely elastic characteristic. In this case, the elastic structure at each support tape absorbs the generated transverse tensile force during the use of the slide fastener, avoiding opening the central slit by the transverse tensile force, improving the fluid impervious function.

(9) The support tapes can be made having a longitudinally elastic characteristic. A waterproof slide fastener using this kind of support tapes provides a side-curving function, widening the application range of the waterproof slide fastener.

(10) The high polymer elastic member at each support tape penetrates into spaces and chinks in between the support tape and the associating row of coupling elements, enhancing smoothness and stability during locking between the two rows of coupling elements.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A continuous-coil type waterproof slide fastener, comprising:

a pair of symmetrical support tapes each having a first face, a second face opposite to said first face forming an inner edge between the second face and a vertical wall of an inner longitudinal edge joining said first face and said second face;

two rows of coupling elements respectively formed of a continuous length of monofilament and respectively secured to said support tapes along said inner edge of the second face of each of said two support tapes;

wherein a high polymer elastic member is bonded to the vertical wall of the inner longitudinal edge of each of said two support tapes and transversely extending from the vertical wall of the inner longitudinal edge of each of said two support tapes to a predetermined distance, said high polymer elastic member further comprising a covering portion on said inner edge of the second face of each of said two support tapes and a filling portion penetrates into inner chinks in each of said two rows of coupling elements;

a fluid impervious film is covered at least on the first face of each of said two support tapes and said high polymer elastic member;

said high polymer elastic member and said fluid impervious film are cut off along a central slit between said two support tapes.

2. The continuous-coil type waterproof slide fastener as claimed in claim 1, wherein said two rows of coupling elements are selectively prepared from rows of C-type coupling elements and rows of S-type coupling elements.

3. The continuous-coil type waterproof slide fastener as claimed in claim 1, wherein said high polymer elastic members are selectively prepared from the material group of thermoplastic urethane and silicon rubber.

4. The continuous-coil type waterproof slide fastener as claimed in claim 1, wherein said fluid impervious films are prepared from polyurethane.

5. The continuous-coil type waterproof slide fastener as claimed in claim 1, wherein said fluid impervious films are prepared from thermoplastic polyurethane and covered with a layer of thermosetting polyurethane.

6. The continuous-coil type waterproof slide fastener as claimed in claim 1, wherein said support tapes are prepared from knitted fabrics elastically stretchable in weft direction.

7. The continuous-coil type waterproof slide fastener as claimed in claim 1, wherein said support tapes are prepared from knitted fabrics elastically stretchable in warp direction.

8. A continuous-coil type waterproof slide fastener, comprising:

a pair of symmetrical support tapes each having a first face, a second face opposite to said first face forming an inner edge between the second face and a vertical wall of an inner longitudinal edge joining said first face and said second face;

two rows of coupling elements respectively formed of a continuous length of monofilament and respectively secured to said support tapes along said inner edge of the second face of each of said two support tapes;

wherein a high polymer elastic member is bonded to the vertical wall of the inner longitudinal edge of each of said two support tapes and transversely extending from the vertical wall of the inner longitudinal edge of each of said two support tapes to a predetermined distance, said high polymer elastic member further comprising a covering portion on said inner edge of the second face of each of said two support tapes and a filling portion penetrates into inner chinks in each of said two rows of coupling elements, said high polymer elastic member being cut off along a central slit between said two support tapes.

9. The continuous-coil type waterproof slide fastener as claimed in claim 8, wherein said support tapes are woven from micro-fiber yarns, having a water repellent characteristic.

10. The continuous-coil type waterproof slide fastener as claimed in claim 8, wherein said support tapes are treated with a water repellent agent to provide a water repellent function.

11. The continuous-coil type waterproof slide fastener as claimed in claim 8, wherein said support tapes are prepared from knitted fabrics elastically stretchable in weft direction.

12. The continuous-coil type waterproof slide fastener as claimed in claim 8, wherein said support tapes are prepared from knitted fabrics elastically stretchable in warp direction.

13. The continuous-coil type waterproof slide fastener as claimed in claim 8, wherein said two rows of coupling elements are selectively prepared from rows of C-type coupling elements and rows of S-type coupling elements.

14. The continuous-coil type waterproof slide fastener as claimed in claim 8, wherein said high polymer elastic members are selectively prepared from the material group of thermoplastic urethane and silicon rubber.

* * * * *